US006032763A

United States Patent [19]

Richter et al.

[11] Patent Number: 6,032,763

[45] Date of Patent: Mar. 7, 2000

[54] EQUIPMENT FOR IMMOBILIZING AN ELEVATOR CAR

[75] Inventors: Utz Richter, Ebikon; Christoph Liebetrau, Menziken, both of Switzerland; Albrecht Morlok, Horb, Germany

[73] Assignee: Inventio AG, Hergiswil NW, Switzerland

[21] Appl. No.: 09/055,571

[22] Filed: Apr. 6, 1998

[30] Foreign Application Priority Data

Apr. 11, 1997 [CH] Switzerland ..... 0848/97

[51] Int. Cl.[7] ..... B66B 5/16

[52] U.S. Cl. ..... 187/377; 187/378; 187/360

[58] Field of Search ..... 187/359, 360, 187/377, 378, 363, 414

[56] References Cited

U.S. PATENT DOCUMENTS

| | | | |
|---|---|---|---|
| 483,145 | 9/1892 | Giles | 187/360 |
| 605,820 | 6/1898 | Hancock | 187/377 |
| 1,124,804 | 1/1915 | Remjas | 187/378 |
| 1,129,536 | 2/1915 | Barash | 187/378 |
| 4,113,119 | 9/1978 | Brown et al. | 187/360 |
| 5,497,855 | 3/1996 | Moore . | |

FOREIGN PATENT DOCUMENTS

| | | |
|---|---|---|
| 0 081 212 | 6/1983 | European Pat. Off. . |
| 1621 | 8/1911 | United Kingdom . |
| 1023227 | 3/1966 | United Kingdom . |

*Primary Examiner*—William E. Terrell
*Assistant Examiner*—Khoi H. Tran
*Attorney, Agent, or Firm*—MacMillan, Sobanski & Todd, LLC

[57] ABSTRACT

A carriage for supporting an elevator car includes a drive unit, a spaced generally parallel support unit and a pair of lower yokes connecting the units. The carriage is movable along a pair of spaced apart generally vertical tracks. The drive unit includes a motor driving a drive axle with a respective drive wheel mounted at each end of the axle which wheels roll along the tracks. The support unit includes a support axle with a respective support wheel mounted at each end of the axle and a clamping device by which friction forces of the drive wheels and of the support wheels are produced on the tracks. The working range of the clamping device can be read off of an indicator. A respective immobilizing equipment is arranged at each side of the lower yoke by which the elevator car can be releasably connected with the track at a desired position along the travel path during assembly of the elevator system and/or during maintenance operations.

7 Claims, 5 Drawing Sheets

EQUIPMENT FOR IMMOBILIZING AN ELEVATOR CAR

BACKGROUND OF THE INVENTION

The invention relates to equipment for immobilizing an elevator car movable along a track wherein the car is releasably connected with the track.

In the European Patent Application No. EP 0 081 212, there is shown equipment by means of which an elevator car movable in a shaft can be fixed in place. The equipment is arranged at the lower yoke carrying the elevator car and cooperates with the leg of the guide rail that guides the car. An electromagnet actuates a push rod that can be advanced in the direction of the shaft wall and which impinges by its free end on an abutment, which is arranged at the foot of the guide rail, during downward travel of the elevator car, whereby the push rod experiences a relative movement upwardly. By the relative movement of the push rod relative to the elevator car, a rod for the actuation of the safety devices, which are arranged one at each side of the elevator car, is pivoted outwardly, wherein a roller of the safety device is moved on an inclined track until the roller wedges between the track and the leg of the guide rail.

A disadvantage of the above described known equipment is that the place at which the elevator car can be fixed is predetermined by the location of the abutment. A further disadvantage is that the roller wedged between the track and guide rail can be freed again only with difficulty after the fixing of the elevator car.

SUMMARY OF THE INVENTION

The equipment according to the present invention has the object of avoiding the disadvantages of the known equipment and of creating an apparatus by means of which the elevator car is easily immobilized and releasable at a desired position in the elevator shaft with little effort.

The advantages achieved by the equipment according to the present invention are essentially to be seen in that during assembly and/or maintenance operations a secure, releasable connection of the elevator car with the track guide elements is producible, wherein the fixing equipment engages in grooves of the guide elements and on release is constrainably guided back into its rest setting. It is further of advantage of the equipment according to the present invention that workable clamping devices of the elevator drive can be released only after immobilization of the elevator car. Also of advantage is that the elevator car does not have to be raised for release from the fixed position.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 4 is an enlarged view of a support wheel that is mounted at a support axle of the elevator drive shown in the FIG. 1*a.

DESCRIPTION OF THE PREFERRED EMBODIMENT

Figure 1:
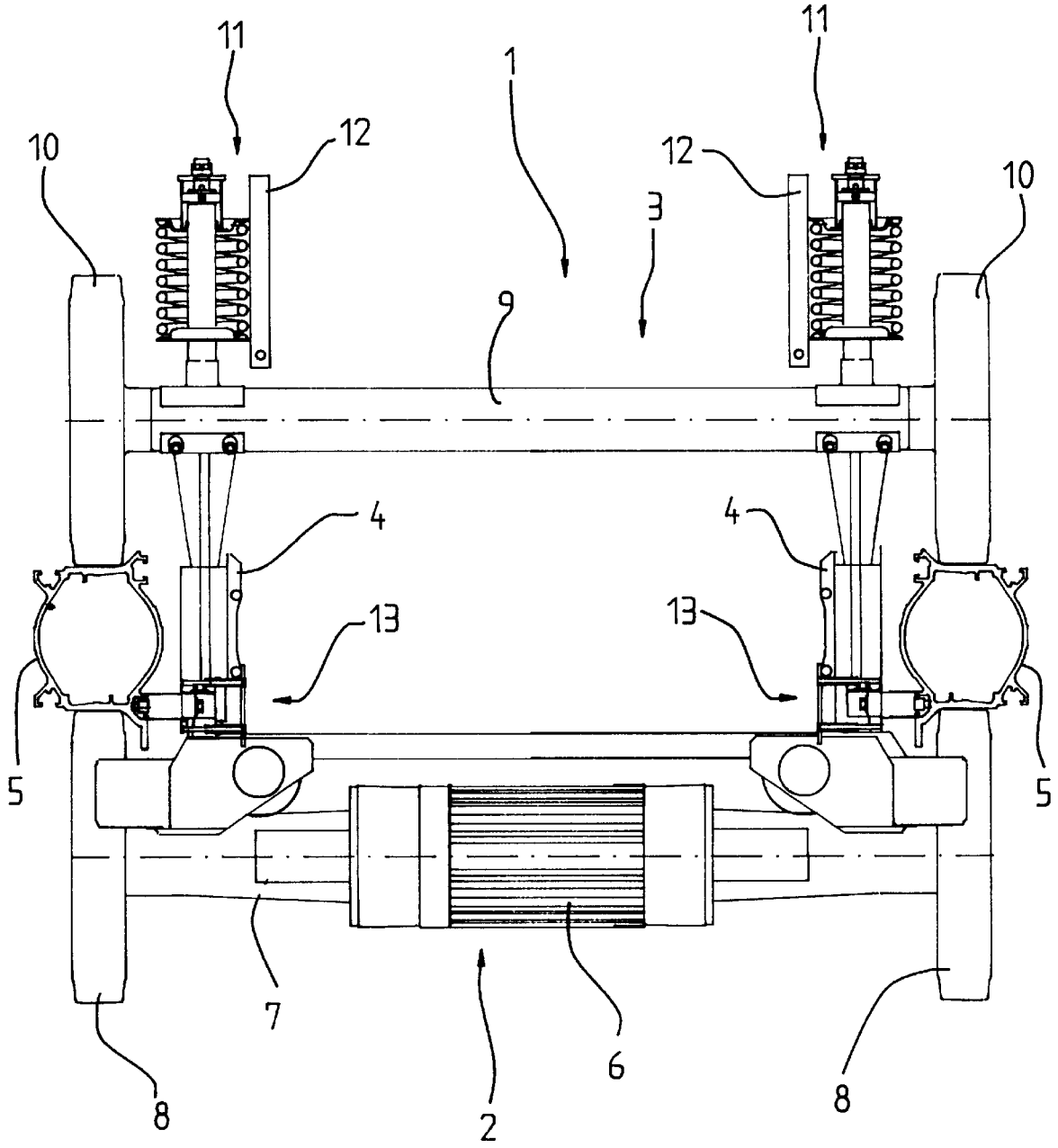
FIG. 1 is a top plan view of an elevator carriage that is movable along a track for guiding an elevator car.

In the FIGS. 1 through 5, there is shown a carriage 1 that carries an elevator car (not shown) and which essentially consists of a drive unit 2, a spaced, generally parallel support unit 3 and a pair of spaced lower yokes 4 each connecting adjacent ends of the drive and support units. The carriage 1 is moveable along a pair of spaced apart tracks 5, for example vertically extending tracks, one such track adjacent each side of the carriage outside of the lower yokes 4. The drive unit 2 consists of a motor 6, a drive axle 7 driven by the motor and a respective drive wheel 8 mounted at each end of the drive axle and which rolls along one of the tracks 5. The support unit 3 consists of a respective support wheel 10 mounted at each end of a support axle 9 and a pair of clamping devices 11 attached to the support axle and each adjacent one of the support wheels. The clamping devices 11 bias the drive wheels 8 and the support wheels 10 against opposite sides of the tracks 5 to produce a friction drive. The working range of each of the clamping devices 11 can be read off of an associated indicator 12. Arranged at each side at the lower yoke 4 is equipment for fixing of the elevator car along a path of travel, identified as immobilizing equipment 13 in the following. By means of the immobilizing equipment 13, which includes a clamping element, the elevator car can be releasably connected with the track 5 at a desired position of the travel path during assembly of the elevator and/or during maintenance operations.

Figure 1A:
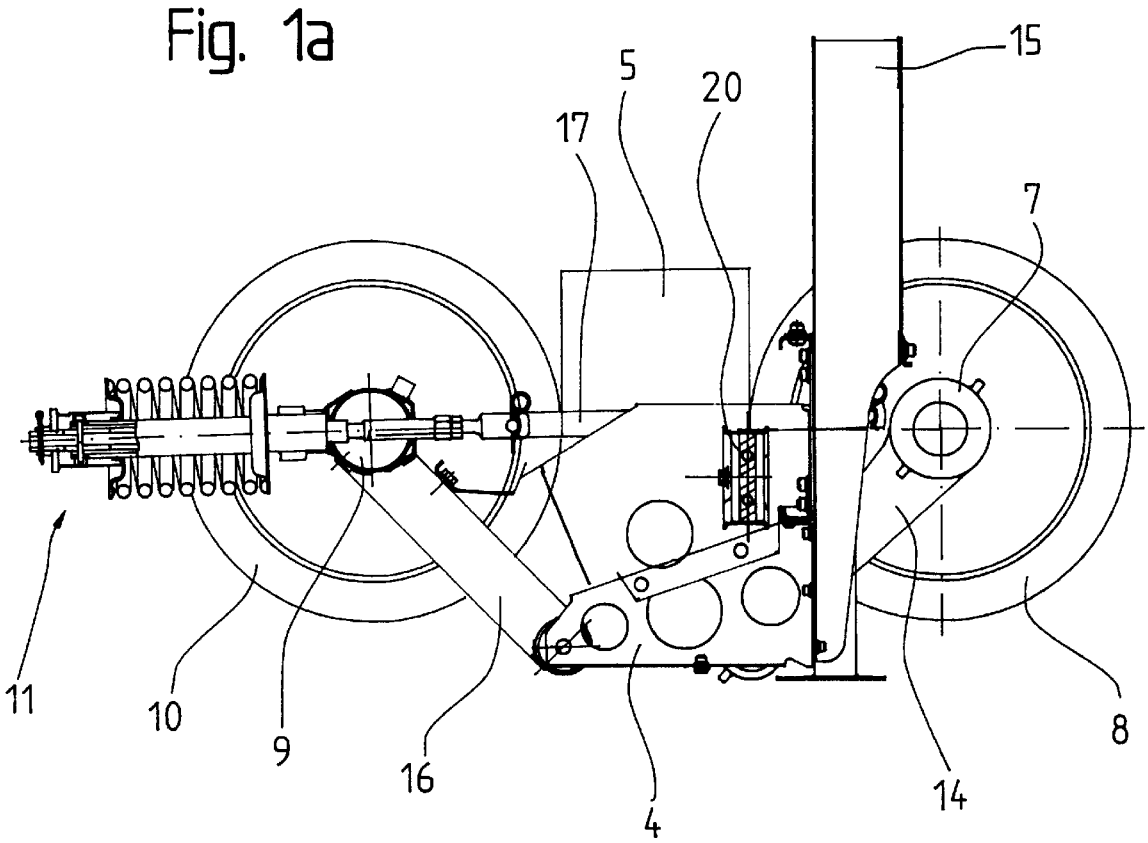
FIG. 1*a* is a side elevation view of the carriage shown in the FIG. 1.
Figure 4:
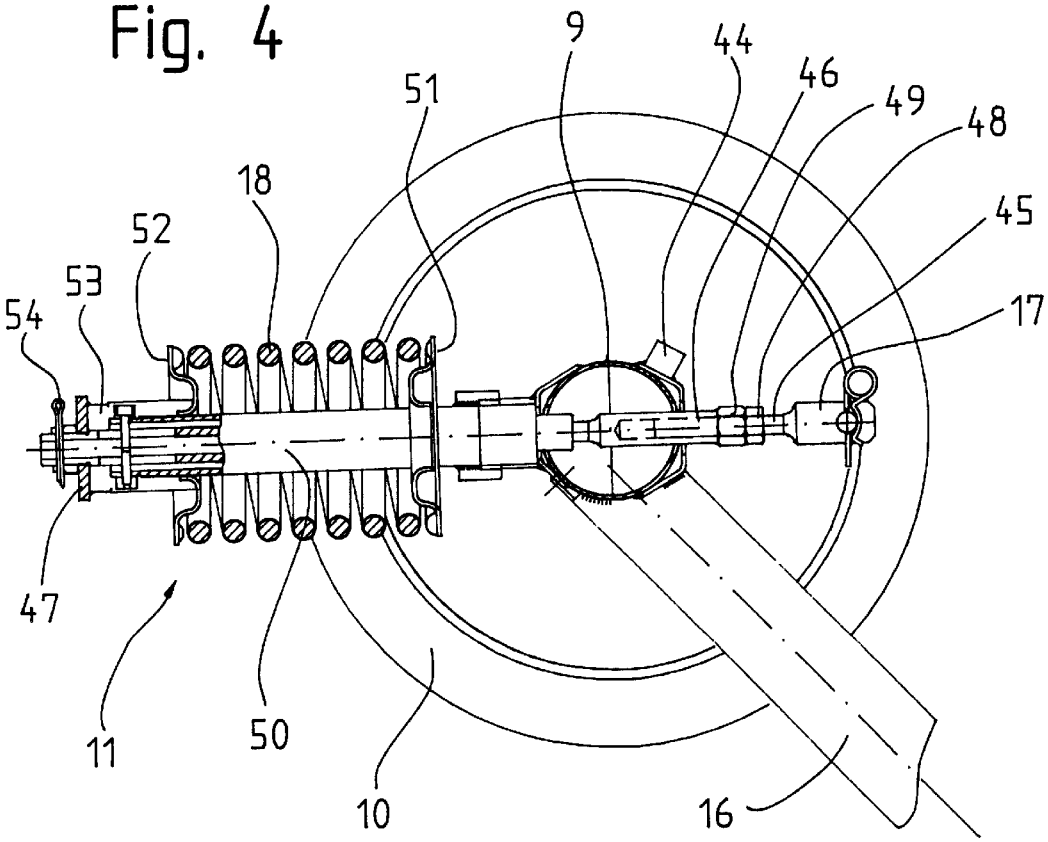

The FIG. 1*a* is a side view of the carriage 1. The drive axle 7 of the drive unit 2 is carried at each end by a respective support 14 rotatably connected with the lower yoke 4. At the drive side of the carriage 1, a respective vertical yoke 15 is connected with the lower yoke 4 at each side. An upper yoke, which is not illustrated, is arranged at the upper end of each of the vertical yokes 15. The lower yoke 4, the drive axle 7, the vertical yoke 15 and the upper yoke form the support frame for the elevator car (not shown). The support axle 9 of the support unit 3 is carried at each end by a respective rocker 16 rotatably connected with the lower yoke 4 and is biased in the direction of the track 5 by the respective clamping device 11 engaging at each end at the support axle. A first pull rod 17 of the clamping device 11 is connected at one end with the lower yoke 4, whilst at the other end the first pull rod is connected with a second pull rod 47 (FIG. 4). A compression spring 18 (FIG. 4) presses the drive wheel 8 and the support wheel 10 against a respective running surface 19 (FIG. 1*b*) of the track 5 and thereby produces the friction force necessary for travel of the elevator car. An opening 20, into which the immobilizing equipment 13 is insertable, is provided at the lower yoke 4.

Figure 1B:
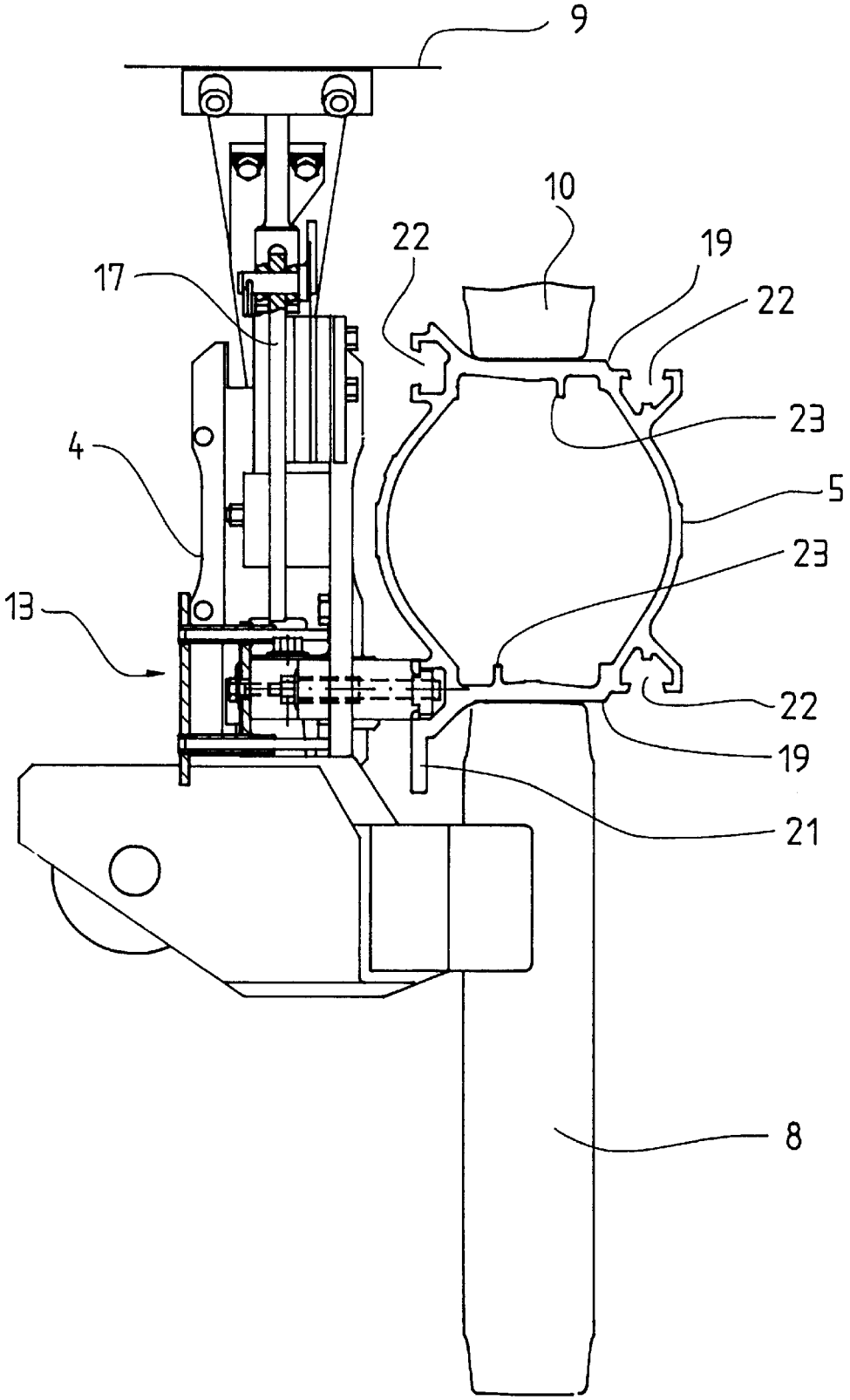
FIG. 1*b* is an enlarged top plan view of the immobilization equipment arranged at a lower yoke of the carriage as shown in the FIG. 1.

As shown in the FIG. 1*b,* the track 5, which is constructed as a hollow body, has a longitudinally extending brake leg 21 formed thereon for engaging a brake, which brake is arranged at the carriage 1 and is not illustrated. At each edge of the running surfaces 19, a respective longitudinally extending anchoring groove 22 is formed which serves for the connection with the immobilizing equipment 13. Guides 23 for guidance of a counterweight, which is not illustrated, are provided in the cavity or hollow interior of the track 5.

Figure 2:
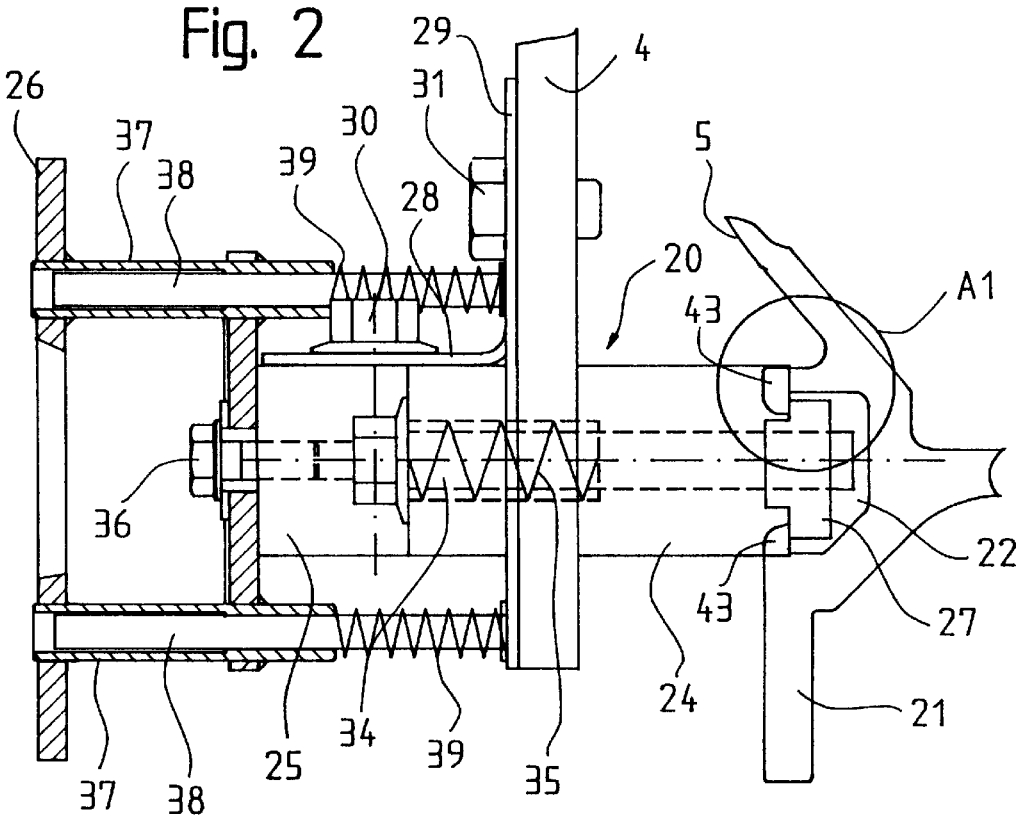
FIG. 2 is an enlarged view of a portion of the FIG. 1*b* showing details of the immobilization equipment arranged at the lower yoke.
Figure 3:
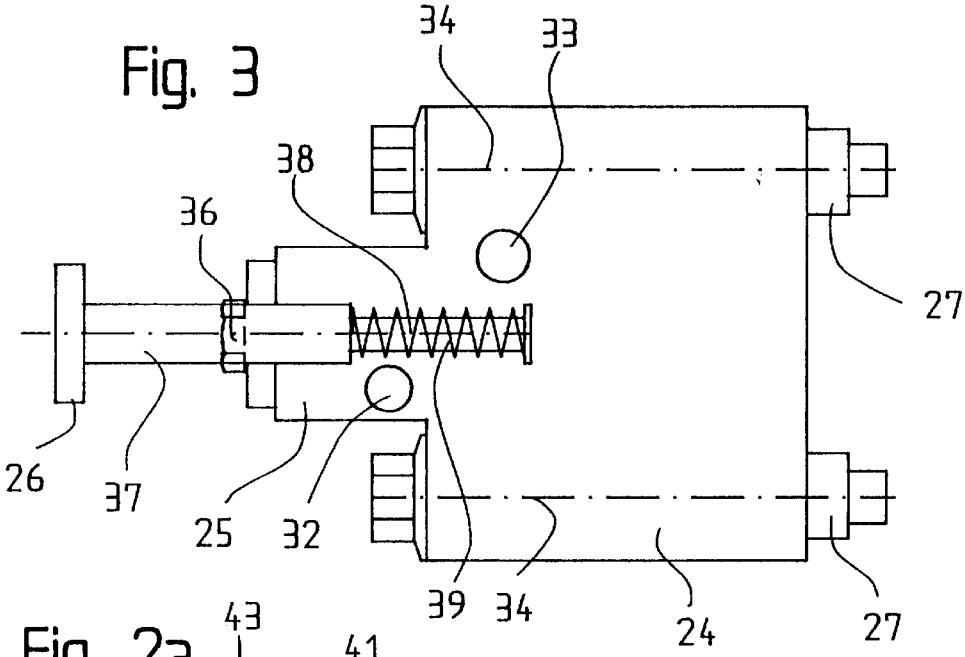
FIG. 3 is an enlarged view of the immobilization equipment shown in the FIG. 2.
Figure 2A:
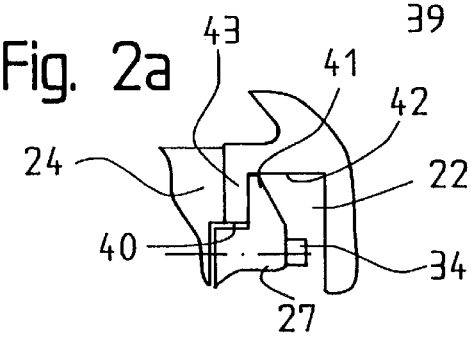
FIG. 2*a* is an enlarged view of a portion of the FIG. 2 designated by "A1" with details of the connection between the immobilization equipment and the track for the elevator car.

The FIGS. 2, 2*a* and 3 show details of the immobilizing equipment 13 and its engagement with the track 5. The immobilizing equipment 13 consists of a body 24 with an axially extending projection 25, an axially extending handle 26 arranged at the projection 25, and a pair of groove blocks 27 extending from the body opposite to the projection. The immobilizing equipment 13 is inserted into the opening 20 of the lower yoke 4 and is made fast to a strap 28 of a carrier plate 29 by means of a first screw 30. The carrier plate 29 has the same opening 20 as the lower yoke 4 formed therein and is made fast to the lower yoke by means of a second screw 31. A first bore 32 extending into the body 24 receives the first screw 30 for the fastening of the immobilizing equipment 13 to the lower yoke 4. A second bore 33 extending into the body 24 functions for the fastening of the immobilizing equipment 13 to the support axle 9. A respective one of the groove blocks 27 is seated at the end of each of a pair of third screws 34, which screws longitudinally penetrate the body 24. A second compression spring 35 is axially arranged in the body 24 and presses the third screw 34 out of the body 24 on release of the connection with the track 5 and lifts the groove block 27 out of the anchoring groove 22. The handle 26 is fastened to the end face of the projection 25 by means of a fourth screw 36 and has sleeves 37 projecting laterally of the projection 25. A respective pin 38 is guided in each sleeve 37 and projects partly out of the sleeve. A third compression spring 39 is co-axially arranged at the projecting part of each of the pins 38. The body 24, the handle 26, the groove blocks 27, and the third screws 34 form a clamping element that is manually connectable with the track 5 as described below.

The strap 28 has a slot-shaped opening formed therein, into which the screw shank of the first screw 30 is pushed during mounting of the immobilizing equipment 13 and the first screw 30 is tightened without further measures. Then the third screw 34 is advanced against the spring force of the second compression spring 35 and turned. The groove block 27 guided in an undercut 40 of the body 24 is rotated with the third screw 34 until a first nose 41 of the groove block is aligned with a wall 42 of the anchoring groove 22, wherein the first nose 41 engages behind a second nose 43 of the anchoring groove 22. On tightening of the third screw 34, the second nose 43 is clamped on between the first nose 41 and the body 24, whereby the carriage 1 is releasably connected with the track 5. Operations on the clamping device 11, the cables or the counterweight can now be carried out free of risk and without the carriage 1 together with the elevator car being able to automatically travel freely in the upward direction or the downward direction. Upon demounting or disconnection of the immobilizing equipment 13, the third screw 34 is released and the groove block 27 is turned back into its starting position. The second compression spring 35 has the effect that the groove block 27 is automatically drawn out of the anchoring groove 22. Loose groove blocks 27 in the anchoring groove 22 are not possible. Thereafter, the first screw 30 is released. The third compression spring 39 has the effect that the immobilizing equipment 13 is pushed away from the lower yoke 4.

The FIG. 4 shows details of the clamping device 11 and the support axle 9. Arranged at the support axle 9 is a first threaded sleeve 44, by means of which, as shown in the FIG. 5, the immobilizing equipment 13 is made fast to the support axle. Arranged at the end of the first pull rod 17 is a threaded pin 45, which pin can be screwed into a threaded sleeve 46 of the second pull rod 47. A first nut 48 is turned against a second nut 49 of the threaded sleeve 46 for securing the threaded pin 45. The second pull rod 47 is guided in a hollow axle 50 over which the first compression spring 18 is co-axially arranged. At the support axle end, the first compression spring 18 ends at a fixed pressure plate 51. The second end of the first compression spring 18 is held by a pressure plate 52 displaceable at the hollow axle 50. A bushing 53 is arranged at the end of the second pull rod 47 and secured by means of a split pin 54. The bushing 53 is connected with the displaceable pressure plate 52. On turning of the threaded sleeve 46, the effective length of the second pull rod 47 is changed, whereby the first compression spring 18 is tensioned or relieved and the support wheel 10 and the drive wheel 8 are pressed to greater or lesser extent against the running surfaces 19 of the track 5.

Figure 5:
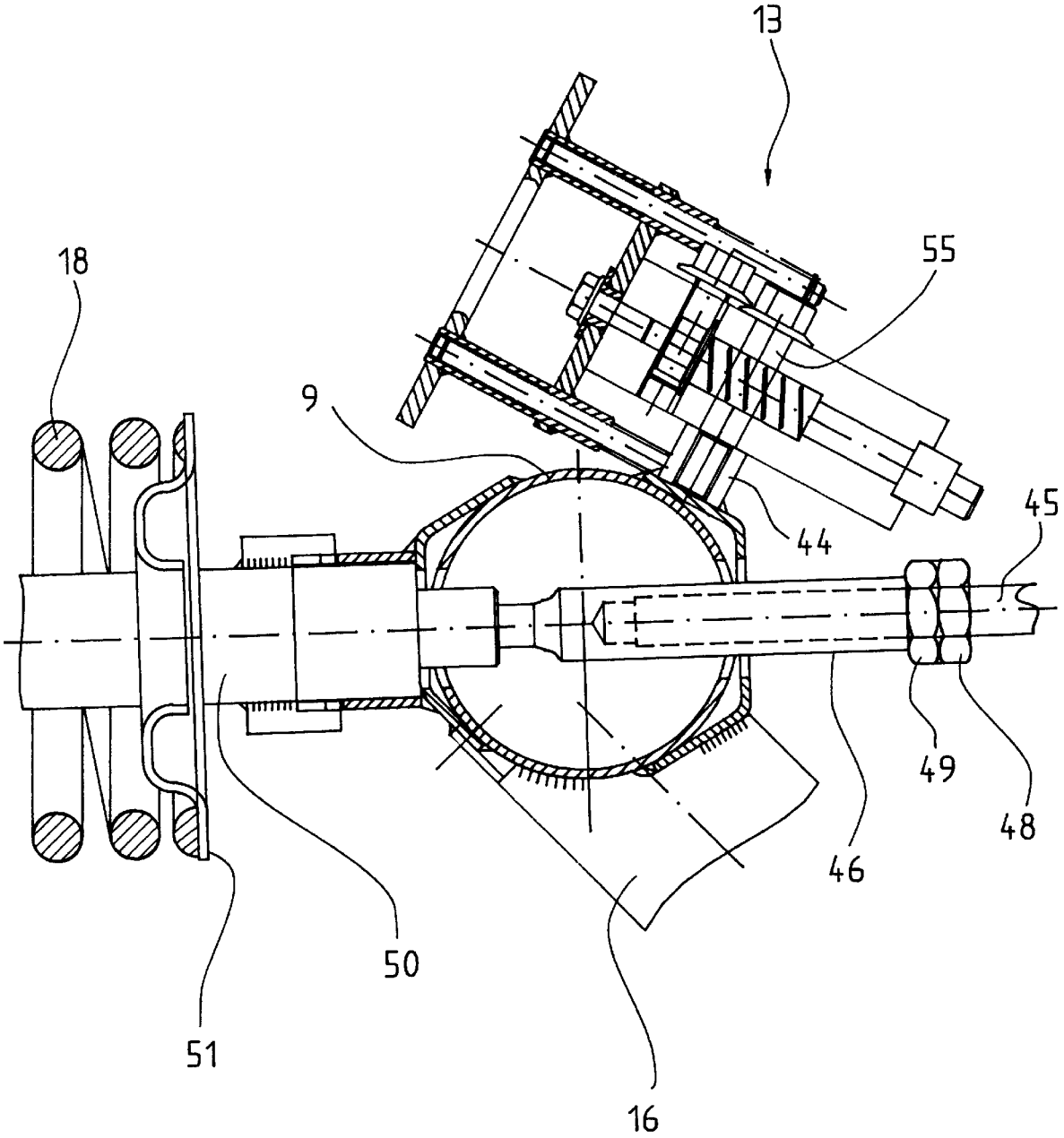
* and FIG. 5 is an enlarged view of the immobilization equipment arranged at the support axle shown in the FIG. 1*a*.

As shown in the FIG. 5, during operation of the elevator car the immobilizing equipment 13 is arranged at the support axle 9. A fifth screw 55 is inserted into the second bore 33 of the body 24 and is screwed into the first threaded sleeve 44 of the support axle 9. The immobilizing equipment 13 placed on the support axle 9 prevents access to the first nut 48 and the second nut 49. Before the clamping device 11 can be operated, the immobilizing equipment 13 must be removed.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Equipment immobilizing an elevator car movable along a track, the elevator car being supported and guided along the track by a carriage, comprising:

a body adapted to be attached to a carriage supporting an elevator car and guiding the elevator car along a track; said trade having anchoring groove a pair of screws extending through said body; and a pair of groove blocks each being mounted on a respective one of said screws whereby when said body is mounted on the carriage, rotation of said screws in a first direction engages said groove blocks with said anchoring groove of the track to fix the carriage and the elevator car any desired position of a travel path of the elevator car along the track and rotation of said screws in a second direction releases said groove blocks from the anchoring groove.

2. The equipment according to the claim 1 including a pair of compression springs each being co-axial with one of said screws for retracting said groove blocks from the anchoring groove after rotation of said screws in said second direction.

3. Equipment immobilizing an elevator car movable along a track comprising: a carriage;

immobilizing equipment means adapted to be attached to the carriage supporting said elevator car and guiding the elevator car along said track, said immobilizing equipment means being selectively engagable with the track at any desired position of a travel path of the elevator car along the track for releasably holding the carriage and the elevator car at the desired position;

said immobilizing equipment means including a clamping element that is manually connectable with the track and moves with the carriage and the elevator car when released from connection with the track; said track having anchoring grooves with walls, and said clamping element including at least one groove block that is insertable into said anchoring groove formed in the track, said groove block engaging a wall of the anchoring groove for connecting the carriage to the track at the desired position.

4. The equipment according to claim 3 wherein said clamping element includes a body, said groove block is mounted on a screw carried by said body and including a compression spring arranged co-axially with said screw whereby when said screw is advanced against a spring force of said compression spring, said groove block is inserted into the anchoring groove, when said screw is tightened, the wall of the anchoring groove is clamped between said body and said groove block, and when said screw is loosened, said groove block is automatically drawn out of the anchoring groove by said compression spring to release the carriage from the track.

5. The equipment according to claim 3 including a handle with a pair of sleeves, a pair of pins on a carrier plate attached to the carriage, said pins being guided in said sleeves, and a compression spring co-axial with each of said pins for pushing said clamping element away from the carrier plate.

6. The equipment according to claim 3 wherein the carriage comprises a drive unit with wheels located thereon, said carriage having a clamping device for frictionally engaging the wheels to the track, said immobilizing equipment means is mounted on the carriage in a position preventing operation of said clamping device on the carriage, to disengage the wheels from the track.

7. Equipment immobilizing an elevator car movable along a generally vertically extending track comprising: said track having a generally longitudinal extending anchoring groove;

a carriage for supporting and guiding the elevator car along the track including wheels, and a clamping device on said carriage for frictionally engaging the wheels with running surfaces on the track;

immobilizing equipment means attached to said carriage and being selectively engagable with said generally longitudinally extending anchoring groove formed in the track at any desired position of a travel path of the elevator car along the track for releasably holding said carriage and the elevator car at the desired position, said immobilizing equipment means preventing operation of said clamping device on said carriage to disengage the wheels from the track.

* * * * *